United States Patent [19]

Schlick

[11] Patent Number: 4,482,301

[45] Date of Patent: Nov. 13, 1984

[54] VALVE CONTROLLED PUMP DRIVEN BY A MOTOR

[75] Inventor: Horst Schlick, Schwalbach, Fed. Rep. of Germany

[73] Assignee: VDO Adolf Schindling AG, Frankfurt am Main, Fed. Rep. of Germany

[21] Appl. No.: 384,816

[22] Filed: Jun. 3, 1982

[30] Foreign Application Priority Data

Jun. 6, 1981 [DE] Fed. Rep. of Germany ..... 3122722

[51] Int. Cl.[3] ..... F04B 9/02; F04B 35/02

[52] U.S. Cl. ..... 417/317; 417/326; 417/413; 417/518

[58] Field of Search ..... 417/518, 519, 239, 413, 417/505, 504, 510, 517, 317, 316, 280, 326, 415, 442; 60/407; 70/264

[56] References Cited

U.S. PATENT DOCUMENTS

| | | | |
|---|---|---|---|
| 1,552,068 | 9/1925 | Lee | 417/415 |
| 1,946,559 | 2/1934 | Weiskopf | 417/415 X |
| 2,724,336 | 11/1955 | Egerton | 417/317 |
| 3,333,543 | 8/1967 | Albaut | 417/510 |
| 4,240,523 | 12/1980 | Nestor et al. | 417/317 |

*Primary Examiner*—Richard E. Gluck
*Assistant Examiner*—Peter M. Cuomo
*Attorney, Agent, or Firm*—Martin A. Farber

[57] ABSTRACT

When a valve-controlled pump is to produce either vacuum or pressure at a pump outlet 9 as a function of its direction of rotation it is necessary that a 3/2-way valve be switched as a function of the direction of rotation of the motor of the pump. In accordance with the invention this is effected by a direction detection device on the motor (1) which is coupled with the motor for the control of the 3/2-way valve. The direction detection device is formed in the manner that the motor housing of the motor (1) is mounted for rotation and is provided at its end with a structural part (11) having a control kidney (10) which is movable over a control surface (7). Since the motor housing must take up the counter moment when the motor is rotating, the control kidney (10) shifts upon the starting of the motor (1) into one of its two end positions depending on the direction of rotation of the motor (1), thereby causing the pump outlet (9) to be connected alternatively to pressure or vacuum.

5 Claims, 7 Drawing Figures

VALVE CONTROLLED PUMP DRIVEN BY A MOTOR

The present invention relates to a motor-driven valve-controlled pump having a 3/2-way valve by which the two pump connections can be connected, depending on the switch position of the 3/2-way valve, to a third valve connection. Such a pump is described, for instance, in U.S. Pat. No. 4,270,371.

In the known pump, the vacuum connection and the pressure connection can be connected alternatively by means of the 3/2-way valve with a third valve connection from which a line leads to the setting members of a device for the unlocking and locking of doors. Depending on the position of the 3/2-way valve, vacuum or pressure is fed to the setting members via the third valve connection so that the setting members either lock or unlock. The 3/2-way valve is switched in positive manner after each disconnection of the pump motor.

For supplying energy to devices for the unlocking and locking of doors, use has also been made of vane pumps, since their direction of rotation can be easily changed in order to produce optionally vacuum or pressure at a pump connection. As example of this prior art reference may be had to U.S. Pat. No. 3,105,127. Vane pumps are, to be sure, considerably more expensive than valve-controlled pumps such as diaphragm pumps, so that, despite the need for a 3/2-way valve, diaphragm pumps have found widespread use in central locking systems.

The object of the present invention is to develop a motor-driven valve-controlled pump of the aforementioned type which can readily take the place of a reversible-direction vane pump but which, as a whole, is cheaper and less susceptible to wear in operation than a vane pump.

This object is achieved in accordance with the invention by a direction detection device (structural part 11) on the motor (1), said device being coupled with the 3/2-way valve in order to switch the valve.

By the direction detection device on the motor in accordance with the invention and the coupling thereof to the 3/2-way valve, the result is obtained that the 3/2-way valve is positively switched when the direction of rotation of the motor is reversed. In this way vacuum is necessarily always produced at one valve connection of the 3/2-way valve upon rotation of the motor in one direction and pressure upon rotation in the other direction.

The motor with the direction detection device and the 3/2-way valve can be readily combined into a structural unit which then can simply be substituted for a vane pump in a vehicle central locking system without the necessity of making any change in the control of the central locking system.

The pump of the invention is particularly simple and economical to produce if the motor housing is mounted for limited rotation and is coupled mechanically to the 3/2-way valve in order to control said valve. Since the counter moment of the motor must be supported via the motor housing, a motor housing of limited rotation swings in positive manner against the stop in one direction or the other depending on the direction of rotation. By the mechanical coupling of the motor housing to the 3/2-way valve, this path of swing can be utilized directly to actuate the 3/2-way valve.

It is also favorable if, in accordance with another embodiment of the invention, the control of the motor (1) has means by which it can be short-circuited upon each disconnection. Since the motor tends by inertia to continue to rotate after disconnect, an opposing field is produced by the short-circuiting so that a counter moment acts on the motor housing. In this way the direction detection device indicates a change in direction immediately upon the disconnection of the motor and already at that time it switches the 3/2-way valve because the housing of the motor is already swinging back. This has the result that in position of rest the system supplied by the pump can be connected with the atmosphere so that the system pressure is released.

The 3/2-way valve can be particularly readily integrated with the motor and the pump to form a single unit if the motor and the direction detection device are developed in the manner that the motor shaft (2) is mounted for rotation on both sides and the motor housing is provided at one end face with a structural part (11) which has a control kidney (10) and rests with limited rotation against a fixed control surface (7) with the two pump connections (5, 6).

Also advantageous is a development of the invention in accordance with which the structural part (11) having the control kidney (10) is provided on the side opposite the control surface (7) with a pressure space (15) which is acted on by the pressure in the control kidney (10). As a result of this measure the structural part forming the control kidney is always acted on by the pressure in the control kidney on the side of said part lying opposite the control surface. Without these measures, the structural part having the control kidney would have to be pressed so firmly against the control surface by a spring that it would not lift off from the control surface even at the maximum pressure. At the maximum vacuum an undesirably large amount of friction would then be present between this structural part and the control surface so that displacement might be impossible.

Further advantageous features of the invention are characterized by the fact that a worm (17) is fastened jointly rotatably on the motor shaft (2), a finger (18) which is coupled with the 3/2-way valve and urged by two springs (19, 20) towards the axial center of the worm engaging into the worm. Furthermore, in accordance with the invention, a gearwheel (21) is arranged jointly rotatably on the motor shaft (2). A leaf spring (22) rests on said gearwheel in such a manner that when the motor is operating it slides in one of its end positions over the teeth of the gearwheel (21), while upon reversal of the direction of rotation it is carried along to its other end position by the teeth and then again slides over the teeth. In this way there is obtained a very simple direction detection device of reliable operation.

The invention permits numerous possible embodiments. Several of them have been shown in the drawing, in part in highly diagrammatic manner, and will be described below:

Figure 1:
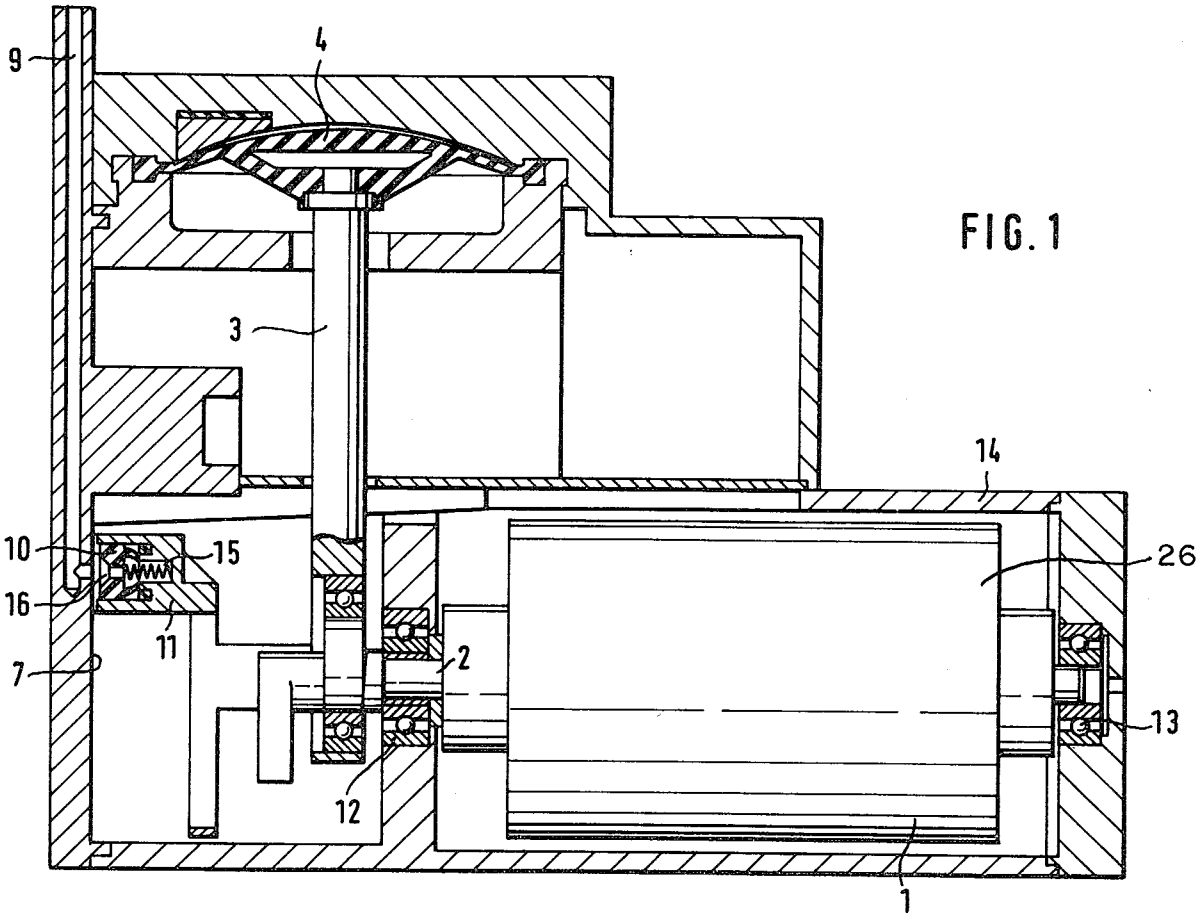
FIG. 1 is a section through a diaphragm pump in accordance with the invention.
Figure 2:
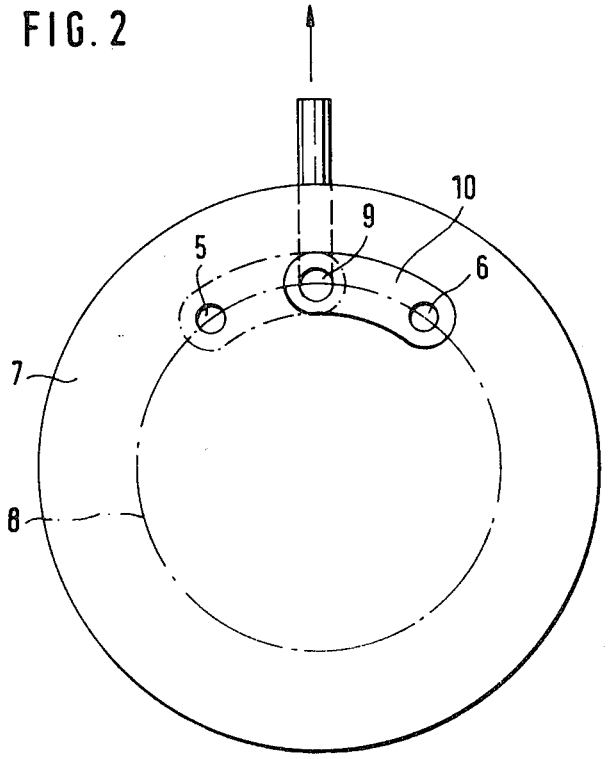
FIG. 2 is a diagram showing the control surface with control kidney of the diaphragm pump of FIG. 1.

FIG. 1 shows, in cross section, a diaphragm pump which has an electric motor 1 which moves a diaphragm 4 back and forth by its motor shaft 2 via a connecting rod 3 which is eccentrically mounted on it. The customary inlet and outlet valves have been omitted from the drawing as well as lines via which vacuum arrives at a first pump connection 5 of a control surface 7 of the pump shown in FIG. 2 and pressure arrives at a second pump connection 6, also shown in FIG. 2. The first and second pump connections 5 and 6 are arranged on a common circular arc 8. Between the pump connections 5, 6 there opens a pump outlet 9 which can be noted also in FIG. 1. Depending on its position with respect to the control surface 7 a control kidney 10 overlaps either the second pump connection 6 and the pump outlet 9 or else the first pump connection 5 and the pump outlet 9 so that the pump outlet 9 is connected optionally to vacuum or pressure.

The control kidney 10 is arranged in a structural part 11. Part 11 is rigidly connected to the housing of the electric motor 1. This electric motor 1 is mounted at both ends for rotation in a housing 14 by means of ball bearings 12, 13 seated on the motor shaft 2; said housing 14 is at the same time the housing for the diaphragm pump. This has the result that the housing 26 of the electric motor 1 together with the structural part 11 and the control kidney 10 turns, depending on the direction of rotation of the electric motor 1, opposite its direction of rotation until it strikes stops not shown in the drawing. As a result, the control kidney 10 also turns and connects the pump outlet 9 depending on its position either with the first pump connection 5 or with the second pump connection 6.

As shown in FIG. 1, a pressure space 15 is provided in the structural part 11 on the side of the control kidney 10 which is opposite the control surface 7, the pressure space 15 being connected via a passage 16 with the pressure space in the control kidney 10 in front of the control surface 7. As a result, the pressure from the pump connections 5 or 6 acts on both sides of the control kidney 10 so that the frictional forces of the control kidney 10 on the control surface 7 do not become undesirably large.

An electric control by which the electric motor 1 is short-circuited upon each disconnect has not been shown in the drawing. This control provides assurance that upon each disconnect, the housing of the electric motor 1 will move, together with the structural part 11 and the control kidney 10 into its end position opposite the position which it has when the electric motor 1 is operating.

Figure 3:
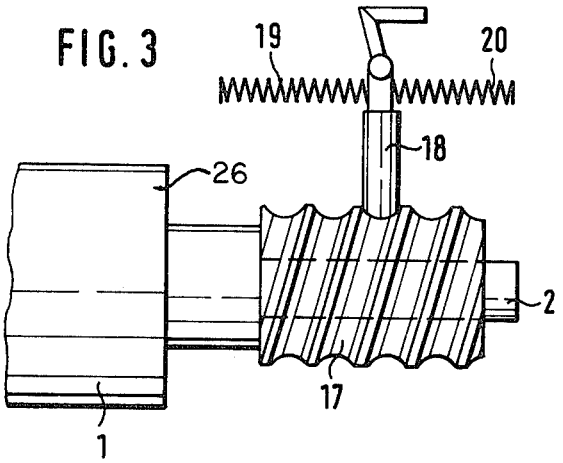
FIG. 3 is a second embodiment of a direction detection device according to the invention.

FIG. 3 shows an electric motor 1 whose housing is arranged in non-turnable manner, in contradistinction to the housing of FIG. 1. A worm 17 is arranged, jointly rotatably, on the motor shaft 2 of the electric motor 1, a finger 18 held by two springs 19, 20 in the center of the worm 17 engaging into said worm. The finger 18 can, for example, be connected mechanically to an ordinary 3/2-way valve by which the two-pump connections are controlled.

When the motor shaft 2 of the electric motor 1 rotates, the worm 17 also rotates. Depending on the direction of rotation of this worm 17, the finger 18 travels out of the worm thread and remains at one end of the worm 17. If the motor shaft 2 turns in the opposite direction, then one of the springs 19, 20 pulls the spring 18 back into the worm thread. The finger 18 then travels to the other end of the worm 17 and initially remains there. The path over which the finger 18 moves due to this movement can be used for switching the 3/2-way valve.

Figure 4:
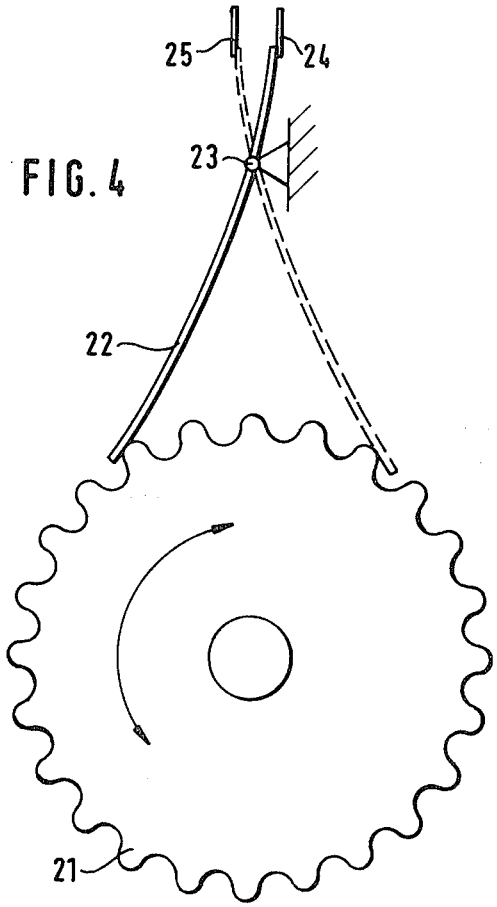
FIG. 4 is a third embodiment of a direction detection device in accordance with the invention.

FIG. 4 shows another embodiment of the direction detection device. Instead of the worm 17, a gearwheel 21 is arranged, fixed for rotation, on the motor shaft 2. A leaf spring 22 rests with tension against this gearwheel. The leaf spring 22 is swingable around a pivot point 23 and contacts an electric contact 24. If the direction of rotation of the gearwheel 21 is opposite, then the gearwheel carries the leaf spring 22 along with it and brings it into the position shown in dashed line in FIG. 4, in which the end thereof facing away from the gearwheel 21 rests against a contact 25. This making of contact as a function of the direction of rotation can be used for control purposes and therefore, for instance, to control the 3/2-way valve. It is also possible, in the place of contacts, 24, 25 to connect the leaf spring 20 mechanically with a 3/2-way valve so that the latter is switched directly by the leaf spring 22.

Herein the term control kidney means a kidney-shaped member 10. This control kidney is mounted in the structural part 11 and biased by a compression spring in a direction toward the control surface 7, but is not relatively moveable otherwise with respect to the structural member 11.

Figure 5:
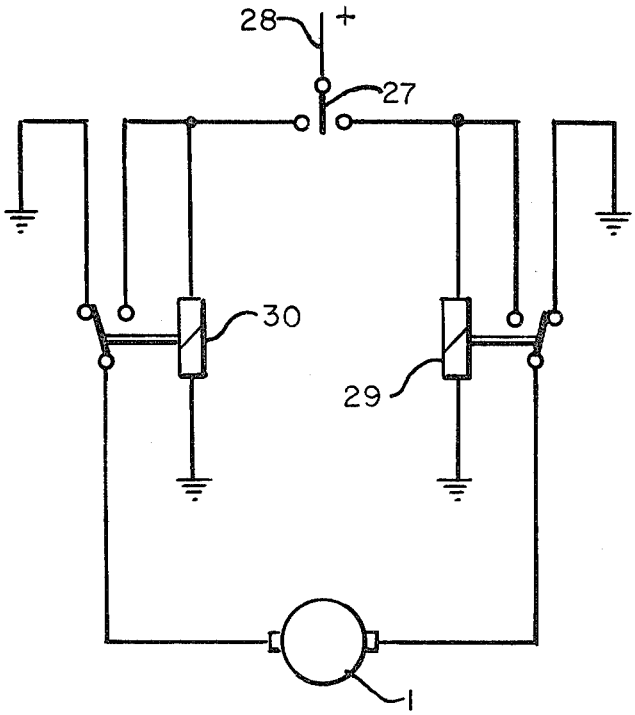
FIG. 5 is an electric circuit diagram for short-circuiting the motor upon disconnection and for reversal of rotation.
Figure 7:
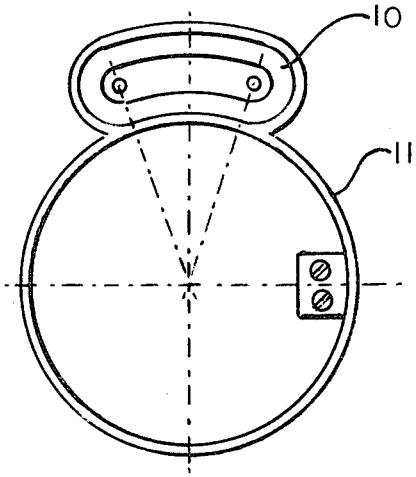
FIG. 7 is a diagram showing showing an enlarged more complete view of the control kidney, of the diaphragm pump of FIG. 1, together with the structural part.
Figure 6:
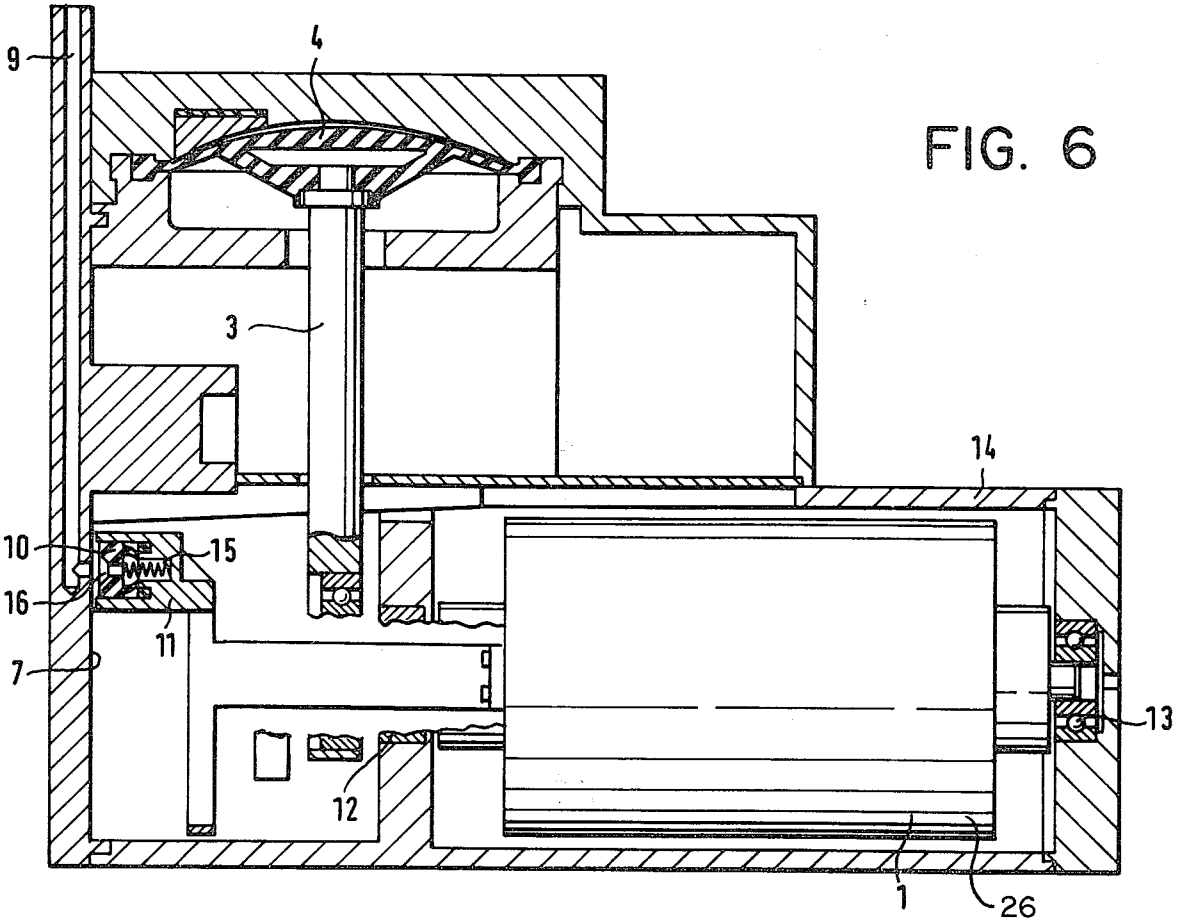
FIG. 6 is a section through the diaphragm pump in accordance with the invention of FIG. 1, partially cut away to show the structural part connected to the housing of the motor.

The electric control circuit shown in FIG. 5 is provided with a control switch 27 which is connected to a positive pole 28 of a DC source. If the control switch 27 is moved from its neutral position, the to its right position relais 29 is applied by DC and switches from its illustrated right position into the left position. By this the motor 1 which is a DC motor will be applied by DC and started in one direction.

If switch 27 is moved again into its illustrated neutral position, the relay 29 moves also into its illustrated right position. Thereby this motor 1 is short-circuited. The last rotation of the motor shaft 2 before stopping will take place against the resistance of the motor 1. In this manner a moment opposite to the direction of movement of motor shaft 2 is created so that the structural part 11 and the control kidney 10, which are connected to the housing 26 of the motor 1 turn into its other end position.

If the switch 27 is moved into its left position the relay 30 is applied with DC and switches from its illustrated left position into its right position. The motor 1 is then connected to DC with a polarization opposite to the polarization of the previously described operation.

In this manner the direction of rotation of the motor shaft is also opposite.

Removing switch 27 into its neutral position the structual part 11 and the control kidney 10 will be moved into its opposite end position according to the principles as described above.

I claim:

1. In a motor-driven valve-controlled pump having a 3/2-way valve by which two pump connections thereof can be connected, respectively, depending on a switch position of the 3/2-way valve, to a third, valve connection of the 3/2-way valve, the pump being driven by a motor, the improvement comprising a direction detection means on the motor, said means being coupled with said 3/2-way valve for switching the latter, the motor has a motor housing which is mounted for limited rotation and is coupled mechanically to the 3/2-way valve for controlling said valve, said motor housing constitutes said direction detection means, said 3/2-way valve includes a structural part having a control kidney, said structural part is connected to the motor housing, said motor has a motor shaft which is mounted for rotation on both ends, said structural part engages against a stationary control surface of the pump containing the two pump connections during the limited rotation of the motor housing, said limited rotation being with respect to the control surface, and said structural part having the control kidney on a side opposite the control surface defines a pressure space communicating with pressure in the control kidney.

2. The pump as set forth in claim 1, further comprising means for controlling the motor includes means for short-circuiting the motor upon each disconnect.

3. The pump as set forth in claim 1, wherein said structural part is connected to one end of the motor housing.

4. The pump as set forth in claim 3, wherein said two pump connections and said third, valve connection are located on a common circular arc, with the third, valve connection being intermediate said two pump connections, said control kidney is of arcuate kidney shape and overlappingly communicates one of said two pump connections respectively with said third, valve connection.

5. In a motor-driven valve-controlled pump having a 3/2-way valve by which two pump connections thereof can be connected, respectively, depending on a switch position of the 3/2-way valve, to a third, valve connection of the 3/2-way valve, the pump being driven by a motor, the improvement comprising a direction detection means on the motor, said means being coupled with said 3/2-way valve for switching the latter, said direction detection means comprises a gearwheel rotatably fixed to a shaft of the motor for rotation therewith, and a leaf spring resting on said gearwheel in such a manner that when the motor is operating, said leaf spring slides in one of its end positions over the teeth of the gearwheel, while upon reversal of the direction of said rotation, said leaf spring is carried along to its other end position by the teeth and then again slides over the teeth.

* * * * *